US008614385B2

(12) United States Patent
McKinney et al.

(10) Patent No.: US 8,614,385 B2
(45) Date of Patent: Dec. 24, 2013

(54) MUSICAL EFFECTS PEDAL RETAINING DEVICE AND PEDAL BOARD

(76) Inventors: Michael J. McKinney, Greenville, SC (US); Charlotte Jane McKinney, legal representative, Greenville, SC (US); Ryan R. Ridgeway, Greenville, SC (US)

( * ) Notice: Subject to any disclaimer, the term of this patent is extended or adjusted under 35 U.S.C. 154(b) by 258 days.

(21) Appl. No.: 13/102,250

(22) Filed: May 6, 2011

(65) Prior Publication Data

US 2011/0271821 A1 Nov. 10, 2011

Related U.S. Application Data

(60) Provisional application No. 61/395,135, filed on May 7, 2010.

(51) Int. Cl.
*G10D 9/00* (2006.01)

(52) U.S. Cl.
USPC ..... 84/453

(58) Field of Classification Search
USPC ..... 84/453
See application file for complete search history.

(56) References Cited

U.S. PATENT DOCUMENTS

| | | | | |
|---|---|---|---|---|
| 3,433,881 | A | 3/1969 | Cotten | |
| D270,917 | S | 10/1983 | Peterson | |
| 4,488,468 | A | 12/1984 | Peterson | |
| 5,091,613 | A | 2/1992 | Rohde | |
| 5,118,017 | A * | 6/1992 | Buck | 224/42.13 |
| 5,452,951 | A * | 9/1995 | Peller | 312/310 |
| 6,215,055 | B1 * | 4/2001 | Saravis | 84/422.1 |
| 6,538,185 | B1 | 3/2003 | Stratton | |
| 6,723,909 | B1 * | 4/2004 | Hooper, II | 84/453 |
| 6,967,272 | B2 * | 11/2005 | Green | 84/421 |
| 7,485,792 | B2 | 2/2009 | Collins, Sr. | |

* cited by examiner

*Primary Examiner* — Christopher Uhlir
(74) *Attorney, Agent, or Firm* — J. Bennett Mullinax, LLC

(57) ABSTRACT

A pedal board is provided that has an attachment mechanism, mounting member, and musical effects pedal retaining device. The attachment mechanism is carried by the musical effects pedal retaining device and functions to attach a musical effects pedal to the musical effects pedal retaining device. At least a portion of the musical effects pedal retaining device is releasably attachable to the mounting member to function to assist making the musical effects pedal releasably attachable to the mounting member. At least a portion of the musical effects pedal retaining device is releasably attachable to the mounting member through a mechanical engagement that is not a hook and loop type fastener.

7 Claims, 7 Drawing Sheets

MUSICAL EFFECTS PEDAL RETAINING DEVICE AND PEDAL BOARD

CROSS REFERENCE TO RELATED APPLICATIONS

This application claims the benefit of U.S. Application Ser. No. 61/395,135 filed on May 7, 2010 and entitled, "Musical Effects Pedal Retaining Device and Pedal Board System." U.S. Application Ser. No. 61/395,135 is incorporated by reference herein in its entirety for all purposes.

FIELD OF THE INVENTION

The present invention relates generally to pedal boards. More particularly, the present application involves a musical effects pedal retaining device for use in retaining a musical effects pedal to a mounting member, and the present application also involves a base assembly that is adjustable in order to change the angle between the musical effects pedal and the floor.

BACKGROUND

Musical effects pedals are attached to a surface and incorporated into a device known as a pedal board. A pedal board is a flat surface to which musical effects pedals are temporarily attached for both transport between locations and for use during musical performances. Most guitar and other stringed instrument artists will use a number of musical effects pedals to vary the sound of their instrument by running the output of the guitar through the musical effects pedals before the output is sent to an amplifier. Each musical effects pedal may be switched on or off and most have additional adjustments which will alter the sound of the instrument and may be controlled by the artist to produce a particular sound or effect. Musicians will often vary the musical effects pedals they wish to use for different performances and require a relatively quick and easy method to change the musical effects pedals on their pedal board to alternate pedals which produce different effects. Additionally, musical effects pedals are sometimes in need of repair or fail to function and need to be removed or replaced on the musician's pedal board. It is not practical to use pedal boards which are large enough to hold every musical effects pedal an artist may use over the course of a longer period of time. For these reasons, attaching a musical effects pedal to a pedal board needs to be a temporary attachment and, at the same time, an attachment which offers stability, security and longevity.

The most commonly used method of attaching musical effects pedals to a pedal board is by using VELCRO® which is a hook and loop material. VELCRO® is the 'standard' for attaching musical effects pedals to pedal boards. A hook and loop material allows for quick and easy replacement of pedals and has the ability to make the position of the pedals adjustable. However, a hook and loop material has some drawbacks in this application. A hook and loop material is not always a secure attachment as it is a temporary attachment system by design. Musical effects pedals can become unattached to the pedal board if the hook and loop material fails to hold it in a manner secure enough to keep it attached during transport, movement or use. This can cause the pedal to become damaged, lost or unusable. Additionally, as musicians push the buttons on the pedals to turn them on and off with their feet, a hook and loop material will compress thus making the pressure to turn the effect on or off vary due to compression of the hook and loop material. This is particularly unwelcome on musical effects pedals where the effect is variable based upon the pressure applied. Hook and loop material attachments also tend to have an amount of movement or rock to the connection. Another drawback of a hook and loop material is the hook and loop material's ability to pick up debris in its hook fabric and in its loop fabric which causes the hook and loop material to become less effective and its appearance to be less than desired.

As previously discussed, a musician uses the musical effects pedals to alter the sound of the instrument's output being transmitted through the musical effects pedals before it is converted to sound waves the audience can hear via an amplifier or sent to a recording device. Each musical effects pedal causes the output from the instrument to be altered or to produce a different sound effect. A musician may use any number of effects pedals during a performance and may need to turn on and off any number of effects during a single song. Musicians use their feet to press buttons or switches on the musical effects pedals to turn them on and off. Additionally, some musical effects pedals are variable and the musician will change a setting on a musical effects pedal with their feet for some period of time during a performance. In essence, a musician may spend a great deal of time touching buttons, switches and pedals on a pedal board.

Pedal boards are traditionally made to lie on the stage floor. Alternatively, the pedal boards may be slanted at some angle toward the musician. The farthest point of the pedal board surface would generally be higher off the floor than the portion of the pedal board closest to the musician. In all cases, the angle relationship between the surface upon which the pedal board rests and the mounting member upon which musical effects pedals are placed is predetermined by the design of the pedal board. To change the angle, the support system for the mounting member would have to be changed, altered or in some way modified from the current condition. The only other option would be to put something under the pedal board to shim it to a different position which may make the pedal board unsteady.

Musicians, like all human beings, vary greatly in height, have different limb lengths, and have differences in their personal preference as to what is most comfortable for them as they play their instrument. Additionally, the ability to reach, touch and adjust each button, switch or pedal on a musical effects pedal attached to a pedal board by the same artist will change considerably if the artist is sitting versus standing. Current pedal boards do not have a system to allow for adjustment within the pedal board's own infrastructure. To change the angle of the musical effects pedal on current pedal boards would require either moving the musical effects pedals to a different pedal board with a different predetermined angle or placing an object between the pedal board and the surface upon which it rests. As such, there remains room for variation and improvement in the art.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs. in which.

Figure 1:
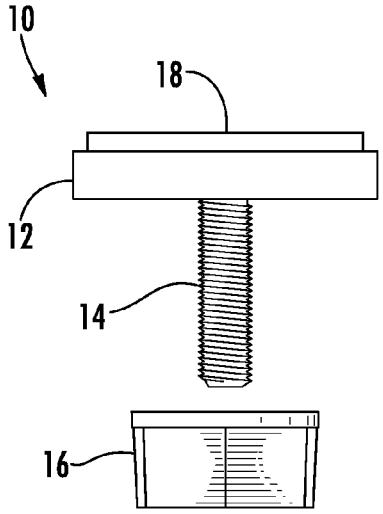
FIG. 1 is a side view of a musical effects pedal retaining device in accordance with one exemplary embodiment.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for a musical effects pedal retaining device 10 that can be used to secure a musical effects pedal 20 to a mounting member 22. The musical effects pedal 20 may be secured in such a manner that it does not move, shift, or vibrate during use and remains thereon during storage or transport. However, the musical effects pedal retaining device 10 is easily detachable from the mounting member 22 so that the musical effects pedal 20 can likewise be easily and quickly removed from the mounting member 22. Multiple musical effects pedal retaining devices 10 can be employed to incorporate any number of musical effects pedals 20 into the pedal board 82. Also provided is a base assembly 64 for a pedal board 82 that can be quickly and easily adjusted by the user so that an angle 80 of the musical effects pedals 20 can likewise be quickly and easily changed with respect to the floor 78. This adjustment may be made to achieve user comfort with the pedal board 82, and may be made so that pedal board 82 can be adjusted without requiring the musical effects pedals 20 to be removed.

With reference now to FIG. 1, one exemplary embodiment of a musical effects pedal retaining device 10 is shown. A connecting device 14 is connected to a mounting plate 12. Basic components of the musical effects pedal retaining device 10 include a mounting plate 12, a connecting device 14, a retaining device 16, and an attachment mechanism 18. One mode of use is to attach the musical effects pedal retaining device 10 to a bottom surface 26 of a musical effects pedal 20 by way of the attachment mechanism 18 using an adhesive, a mechanical attachment system or other methodology for joining two surfaces thus attaching the mounting plate 12 to the bottom surface 26 the musical effects pedal 20. The connecting device 14 is connected to the mounting plate 12 and thus to the musical effects pedal 20 which will allow the connecting device 12 to be inserted through an opening 24 in a mounting member 22 and retained in place by the retaining device 16 thus attaching the effects pedal 20 to the mounting member 22. The retaining device 16 may have internal threads that are complimentary to external threads on the connecting device 14 to effect releasable attachment. The mounting member 22 may be a flat surface, a convex curved surface, a concave curved surface, or a plurality of different surfaces having different shapes and angles. As such, the mounting member 22 can be variously configured in other arrangements and need not be a flat, generally planar surface.

Components of the musical effects pedal retaining device 10 such as the mounting plate 12, the connecting device 14, and the retaining device 16 may be fashioned from any rigid or semi-rigid material, such as any variety or combination of metal or plastic having these qualities but not limited to: metal alloys, tin, aluminum, steel, wood, polyethylene, polypropylene, polyethylene terephalate, polyvinyl chloride, polycarbonate, or acrylonitrile butadiene styrene.

The attachment mechanism 18 may be fashioned from an adhesive, glue, double-sided adhesive tape, magnet, mechanical attachment system or other material or method as one reasonably skilled in the art could envision a variety of fastening systems that would serve the same function. The attachment mechanism 18 may function to permanently attach the musical effects pedal 20 to the mounting plate 12. Alternatively, the attachment mechanism 18 can be a releasable attachment so that the user may attach the musical effects pedal 20 to the mounting plate 12, and then remove the musical effects pedal 20 from the mounting plate 12 when desired, and then reattach these components. The attachment mechanism 18 may be any object or system capable of attaching the musical effects pedal 20 to the mounting plate 12 either permanently or releasably.

Figure 5:
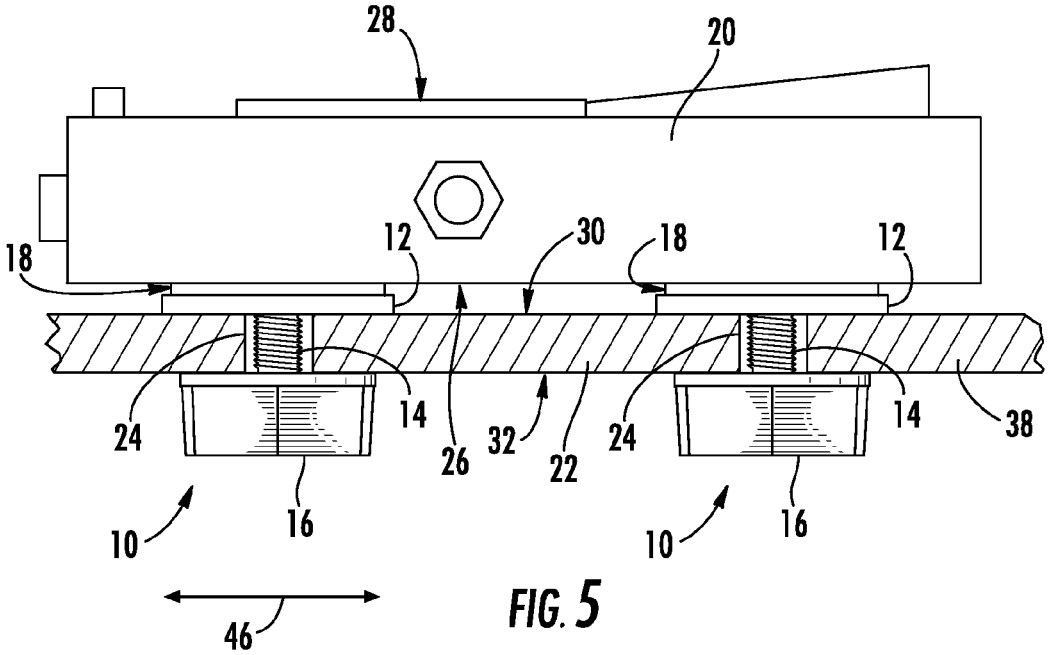
FIG. 5 is a side elevation view of a musical effects pedal attached to the musical effects pedal retaining device of FIG. 1 and to a mounting member.

The connection device 14 may be fashioned in the form of a threaded screw type connection method, a push-to-lock type connection method, a turn-to-lock type connection method or other connection method as one reasonably skilled in the art could envision a variety of fastening systems that would serve the same function. The function of the connection device 14 and the retaining device 16 is to create a connection where the two parts may be completely separated at one time, and at another time be joined together so they act as one continuous part which may be adjusted so the length of the connection may be shortened so as to create a vise-type action where the two components would create a compression upon an object between the two components in the same way a nut and bolt work together to compress and hold items against each other or together. In this application, the mounting plate 12 is either connected to or is part of the same component as the connection device 14 and the retaining device 16 is the second component. The connection device 14 may be inserted trough an opening 24 in a mounting member 22 to the point where the mounting plate 12 lies parallel to an upper surface 30 of the mounting member 22. The retaining device 16 would be joined to the connecting device 14 and, as the length of their connection is shortened, an upper surface of the retaining device 16 nearest the mounting plate 12 would be drawn toward the mounting plate 12 until the length of the connection was sufficiently short enough to compress and hold the mounting plate 12 to the mounting member 22 and the retaining device 16 to an opposite, lower surface 32 of the mounting member 22 as depicted in FIG. 5 to follow.

FIG. 1 depicts a connecting device 14 which one reasonably skilled in the art may know as a "male" type connection. The retaining device 16, in similar fashion, would be known as a "female" type connection.

Figure 2:
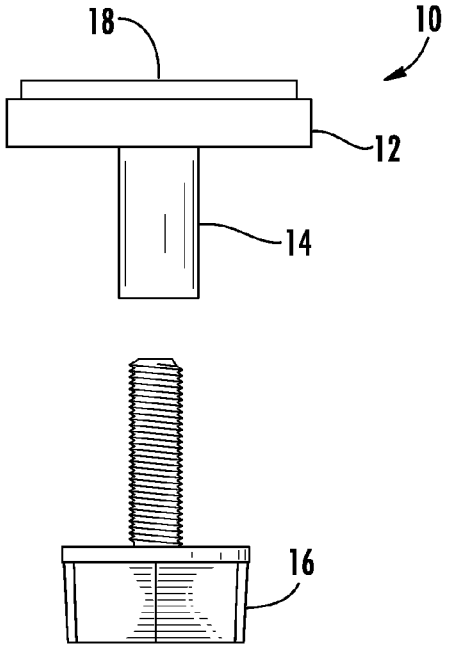
FIG. 2 is a side view of a musical effects pedal retaining device in accordance with another exemplary embodiment.

With reference now to FIG. 2, another exemplary embodiment of a musical effects pedal retaining device 10 is illustrated. The connecting device 14 is connected to the retaining device 16 but otherwise has essentially the same features as FIG. 1. The embodiment in FIG. 2 further depicts a connecting device 14 which one reasonably skilled in the art may know as a "female" type connection. The retaining device 16 would be a "male" type connection in this example. The function of the connection would be primarily the same as described above in FIG. 1. As disclosed, the connecting device 14 can be integrally formed with the mounting plate 12 or may be permanently attached to the mounting plate 12. The retaining device 16 has an exterior surface that is a handle that can be grasped and rotated by the user. A shaft with external threading thereon extends from the handle of the retaining device 16 and may be integrally formed with the handle or permanently attached to the handle. The external threading of the retaining device 16 may mate with complimentary internal threading in the opening of the connecting device 14 in order to secure these two components to one another.

Figure 3:
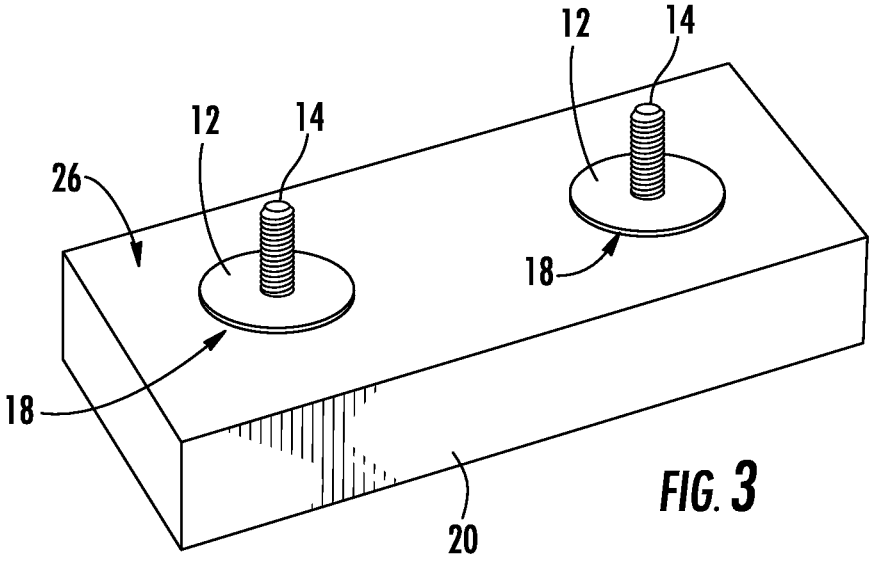
FIG. 3 is a perspective view of a musical effects pedal with portions of a musical effects pedal retaining device located thereon in accordance with one exemplary embodiment.
Figure 4:
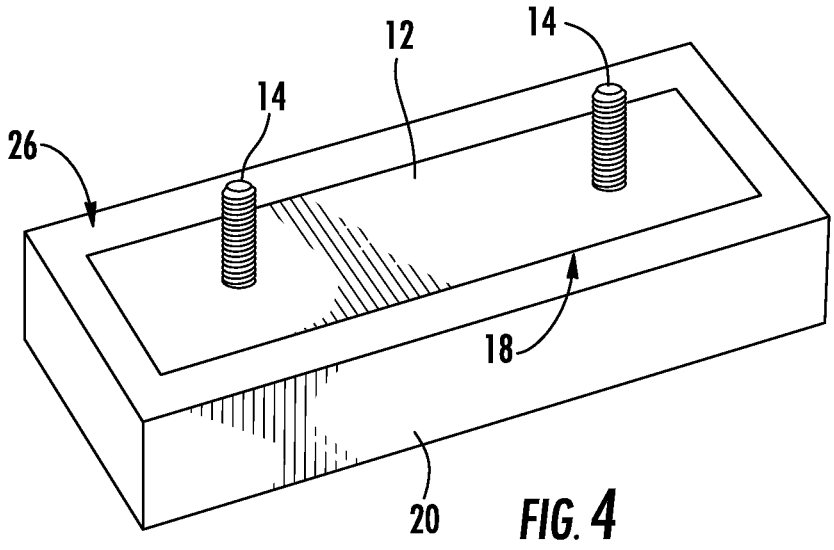
FIG. 4 is a perspective view of a musical effects pedal with portions of a musical effects pedal retaining device located thereon in accordance with another exemplary embodiment.

FIGS. 3 and 4 are perspective views of two exemplary embodiments of a musical effects pedal retaining device 10 attached to bottom surfaces 26 of musical effects pedals 20 using unseen attachment mechanisms 18. The attachment mechanisms 18 may be double sided adhesive tape or may be glue or other adhesive that functions to attach the mounting plates 12 to the bottom surfaces 26 of the musical effects pedal 20. FIG. 3 depicts two musical effects pedal retaining devices 10 attached to one musical effects pedal 20 with one connecting device 14 per musical effects pedal retaining device 10. FIG. 4 depicts one musical effects pedal retaining device 10 with a larger mounting plate 12 and multiple connecting devices 14. One reasonably skilled in the art could envision any variety of mounting plate 12 sizes and/or shapes and any number of connecting devices 14 that would serve a similar function. The preferred mounting plate's 12 shape and size may be dictated by the size and shape of the musical effects pedal 20, or the bottom surface 26 of the musical effects pedal 20 to which it will attach as well as the number of connecting devices 14 desired to secure the mounting plate 12 to the desired mounting member 22. Although shown and described as being attached to the bottom surface 26, it is to be understood that the musical effects retaining device 10 may be attached to different portions of the musical effects pedal 20 in other embodiments, or may be attached to both the bottom surface 26 in addition to other portions of the musical effects pedal 20 in other arrangements.

Figure 6:
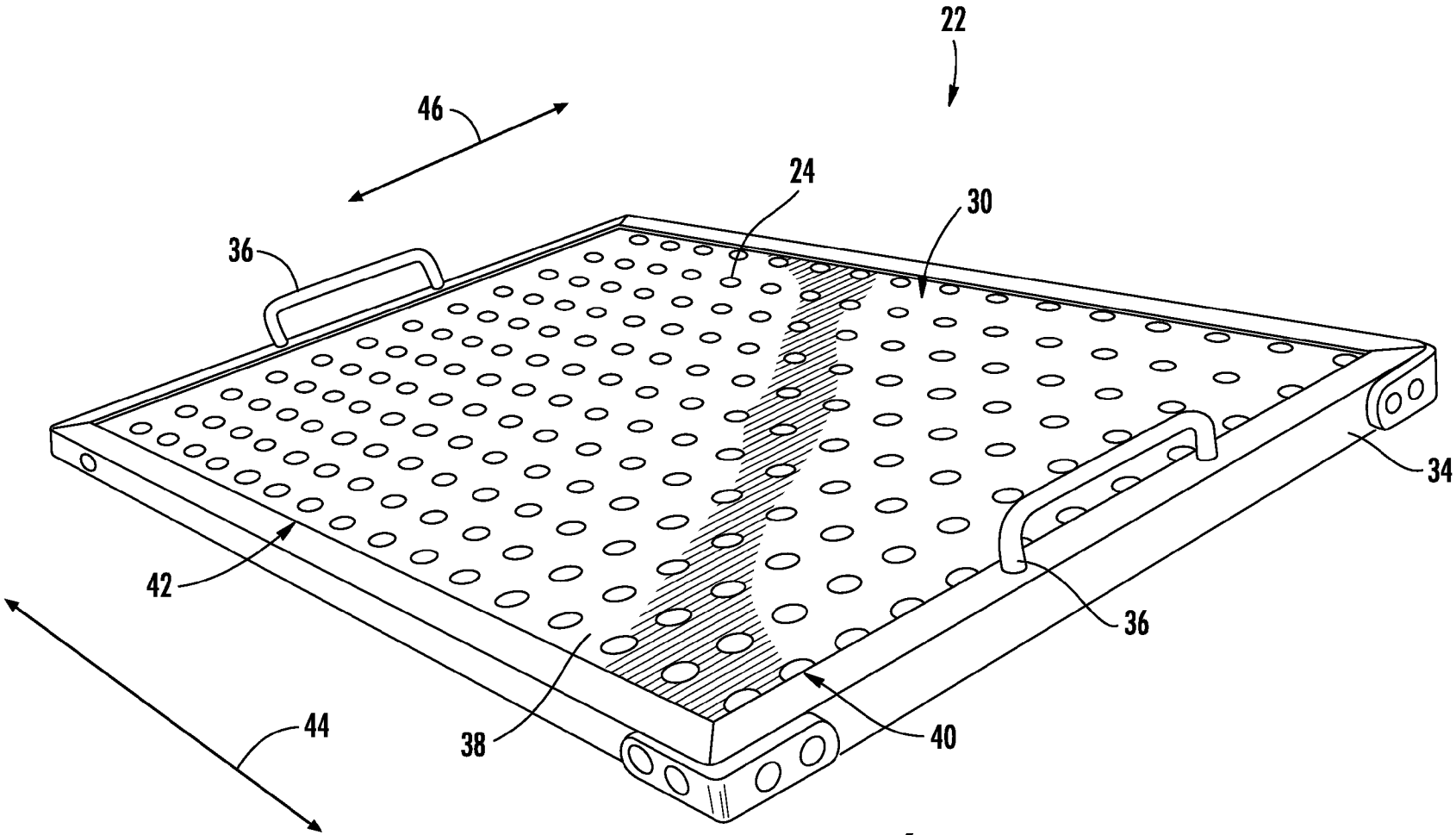
FIG. 6 is a perspective view of a mounting member in accordance with one exemplary embodiment.
Figure 7:
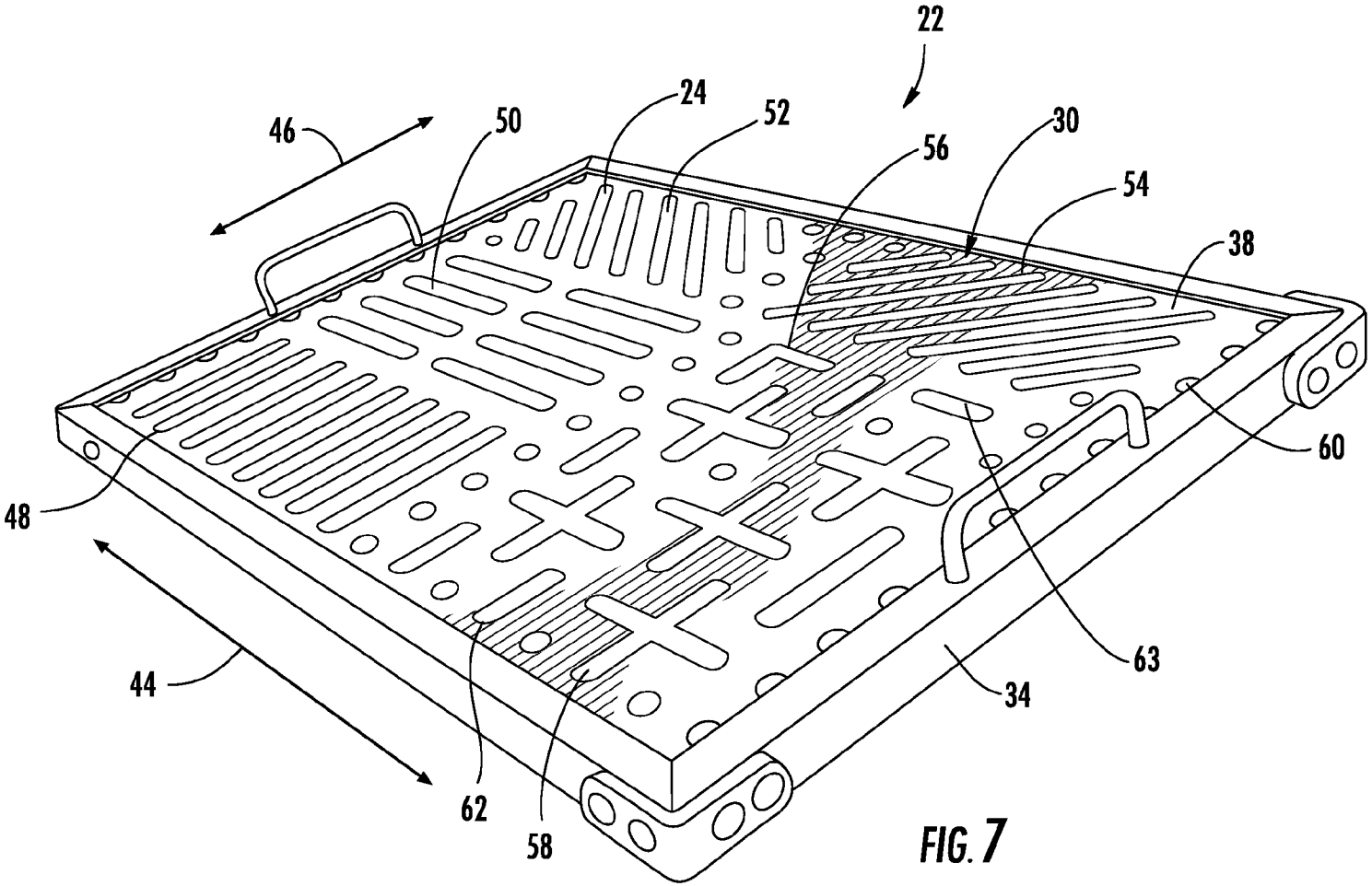
FIG. 7 is a perspective view of a mounting member in accordance with a different exemplary embodiment.

FIG. 5 is a detail drawing of two musical effects pedal retaining devices 10 attached to the bottom surface 26 of a musical effects pedal 20 using the attachment mechanisms 18 to attach the mounting plates 12 and the connecting devices 14 to the musical effects pedal 20. FIG. 5 further depicts the connecting devices 14 being placed through openings 24 in the mounting member 22 and retained in place by the retaining devices 16. The arrangement in FIG. 5 may be viewed as an attachment of a musical effects pedal 20 with two musical effects pedal retaining devices 10 attached to the musical effects pedal 20 as depicted in FIG. 3 to a mounting member 22 as depicted in FIGS. 6 and 7 by use of openings 24 in the mounting member 22. As disclosed, the openings 24 extend from a lower surface 32 of the mounting member 22 to an upper surface 30 of the mounting member 22.

The mounting plates 12 engage the upper surface 30, and the connecting devices 14 extend completely through the openings 24 so that they extend some amount past the lower surface 32. The retaining devices 16 engage the connecting devices 14 and are rotated thereon to engage the threading such that the retaining devices 16 are drawn against the lower surface 32. The retaining devices 16 can be tightened by the user so that the mounting plates 12 and attached attachment mechanisms 18 and musical effects pedal 20 are drawn tightly and securely against the upper surface 30. The upper surface 30 may be a flat surface, although the openings 24 may be disposed across the face of the upper surface 30 the portions that do not include the openings 24 may be flat having the same vertical height. The mounting plates 12 contact the upper surface 30, while the attachment mechanisms 18 and musical effects pedal 20 do not contact the upper surface 30. The musical effects pedal 20 may thus be securely attached to the mounting member 22.

Any number of musical effects pedal retaining devices 10 may be used to place the musical effects pedal 20 into releasably attachment with the mounting member 22. For example, from 1-10, from 10-20, or up to 30 musical effects pedal retaining devices 10 may be used with one of the musical effects pedals 20 to cause the musical effects pedal 20 be to attached to the mounting member 22. The mounting plate 12 for each one of the musical effects pedal retaining devices 10 may be a separate mounting plate, or may be integrally formed such that the mounting plate 12 for each one of the musical effects pedal retaining devices 10 may be but a portion of the larger, integrally formed plate.

FIG. 6 is a perspective drawing of a mounting member 22 for musical effects pedals 20 which could be used in conjunction with a musical effects pedal retaining device 10 described previously. The drawing depicts a unique central member 38 retained within a support frame 34 with support frame handles 36 installed to facilitate moving the entire unit. The central member 38 may be integrally formed with the support frame 34, or may be a separate component that is attached to the support frame 34 and held thereon. The handles 36 may be integrally formed with the support frame 34 or can be separately attached, and two handles 36 may be present on opposite ends of the support frame 34 to facilitate holding and transport. The handles 36 can be on the same side of the support frame 34, or may be on opposite sides so that one handle 36 is on a front side while another handle 36 is on a back side. The handles 36 may be on adjoining sides of the support frame 34. The handles 36 may be on the mounting member 22 as well or on the base assembly 64 in other exemplary embodiments. As such, the handles 36 can be located on any component at any place of the pedal board 82. Any number of handles 36 may be used. For example, from 1-4, from 4-10, or up to 20 handles 36 may be used in accordance with different exemplary embodiments.

A unique aspect of a mounting member 22 shown in FIG. 6 is a pattern of openings, generally designated as reference item 24, that are across the upper surface 30 for the purpose of attaching musical effects pedals 20. These openings 24 may cover the entire central member 38 of the mounting member 22 or a portion of the central member 38 and may be in any number. Each opening 24 may be positioned in a manner where the distance between openings 24 is consistent in a manner where if multiple musical effects pedal retaining devices 10 were installed on a musical effects pedal 20 and the retaining devices' connecting devices 14 could be inserted into one set of multiple openings 24, the musical effects pedal 20 could be removed from its current openings 24 and placed into other openings 24 since the pattern between the openings 24 may be consistent.

The mounting member 22 is shown as extending in a longitudinal direction 44 and a lateral direction 46. The openings 24 may be arranged in a series of rows 40 that extend in the longitudinal direction 44, and in a series of columns 42 that extend in the lateral direction 46. The openings 24 may be evenly spaced from consecutive openings 24 along each one of the rows 40 and along each one of the columns 42. Each one of the rows 40 may contain the same number of openings 24, and each one of the columns 42 may contain the same number of openings 24. The openings 24 may be circular openings and can extend completely through the entire width of the central member 38 from its upper surface 30 to its lower surface 32. The openings 24 can be variously shaped in other exemplary embodiments. For example, instead of being circular holes, the openings 24 may be hexagonal holes, slots, triangular shaped openings, rectangular shaped openings, irregular shaped openings, or poly-sided shaped openings in other arrangements.

The consistent pattern between openings 24 would facilitate the ability to move musical effects pedals 20 on a pedal board 82 and also facilitate the ability to move them 20 to other pedal boards 82 which use the same unique and preferable mounting member 22 described here.

The mounting member 22 may be fashioned from any rigid or semi-rigid material, such as any variety or combination of metal or plastic having these qualities but not limited to: metal alloys, tin, aluminum, steel, wood, polyethylene, polypropylene, polyethylene terephalate, polyvinyl chloride, polycarbonate, or acrylonitrile butadiene styrene.

FIG. 7 is a perspective drawing of a mounting member 22 for musical effects pedals 20 which could be used in conjunction with a musical effects pedal retaining device 10 described previously, and is a variation of the mounting member 22 described in FIG. 6. The embodiment in FIG. 7 depicts a unique mounting member 22 with variations in the shape and configurations of the openings 24. A variety of shapes and configurations where the principle described in FIG. 6 would still apply. These may include the ability to move a musical effects pedal 20 using the musical effects pedal retaining device 10 as described herein from one defined set of openings 24 to another without moving the musical effects pedal retaining devices 10 attachment to the musical effects pedal 20. This would be possible due to the consistent spacing and placement of the openings 24 in the mounting member 22.

Some of the openings 24 are lateral apertures 48 that are arranged in rows in the longitudinal direction 44 and that extend an equal distance in the lateral direction 46. The lateral apertures 48 are slots that may be spaced equally from one another in the longitudinal direction 44 and may be parallel to one another. Additional openings 24 can be configured as longitudinal apertures 50 that are slots that extend in the longitudinal direction 44. The longitudinal apertures 50 can be arranged in two rows, and an equal number of longitudinal apertures 50 may be present in each row. The longitudinal apertures 50 may be equally spaced from consecutive longitudinal apertures 50 in the lateral direction 46. The lengths of the lateral apertures 48 may all be the same as one another, and the lengths of the longitudinal apertures 50 may all be the same as one another.

Some of the openings 24 may be configured as angled apertures 52 that are slots that extend so as to have a component in both the longitudinal direction 44 and the lateral direction 46. All of the angled apertures 52 may be parallel to one another. The lengths of the angled apertures 52 may be such that some consecutive angled apertures 52 have different lengths, while some of the consecutive angled apertures 52 have the same lengths. A second set of angled apertures 54 may also be included and can be slots that extend in both the longitudinal direction 44 and the lateral direction 46 and are all parallel to one another, yet are not parallel to the angled apertures 52. The angled apertures 54 may have lengths that are the same as one another or are different from one another.

An additional opening 24 may be arranged as an L-shaped aperture 56 that has a leg that extends only in the lateral direction 46 and a leg that extends only in the longitudinal direction 44 that are contiguous and joined to one another. The L-shaped aperture 56 may be a slot. Although only a single L-shaped aperture 56 is present, it is to be understood that a plurality of L-shaped apertures 56 may be included in other arrangements. A plurality of cross-apertures 58 can be included and may arms that extend in the longitudinal direction 44 that are intersected at their mid-points by arms that extend in the lateral direction 46. The lengths of the arms of the cross-apertures 58 may be equal so that the cross-apertures 58 are in the shape of a "+" sign. The arms may also be slots in shape.

A plurality of lateral apertures 62 can be present and may extend in the lateral direction 46. The lateral apertures 62 may be five in number and can be parallel to one another. Some of the lateral apertures 62 may have the same length as one another, and some of the lateral apertures 62 may have different lengths from one another. A longitudinal aperture 63 can be included and may extend in the longitudinal direction 44.

Circular apertures 60 can be included as well and may be disposed so that there is a row of circular apertures 60 between the apertures 48, 50, 52 and the apertures 54, 56, 58, 62, 63. The circular apertures 60 may all be of the same size. Some of the circular apertures 60 may be disposed so that they are located between the cross apertures 58. A row of circular apertures 60 may be located between all of the apertures 48, 50, 52, 54, 56, 58, 62, 63 and an edge of the central member 38.

The apertures 48, 50, 52, 54, 56, 58, 62 and 63 may be formed by slots. The slots extend completely through the upper surface 30 and the lower surface 32. The slots are curved on their ends and are straight along their lengths.

Figure 8:
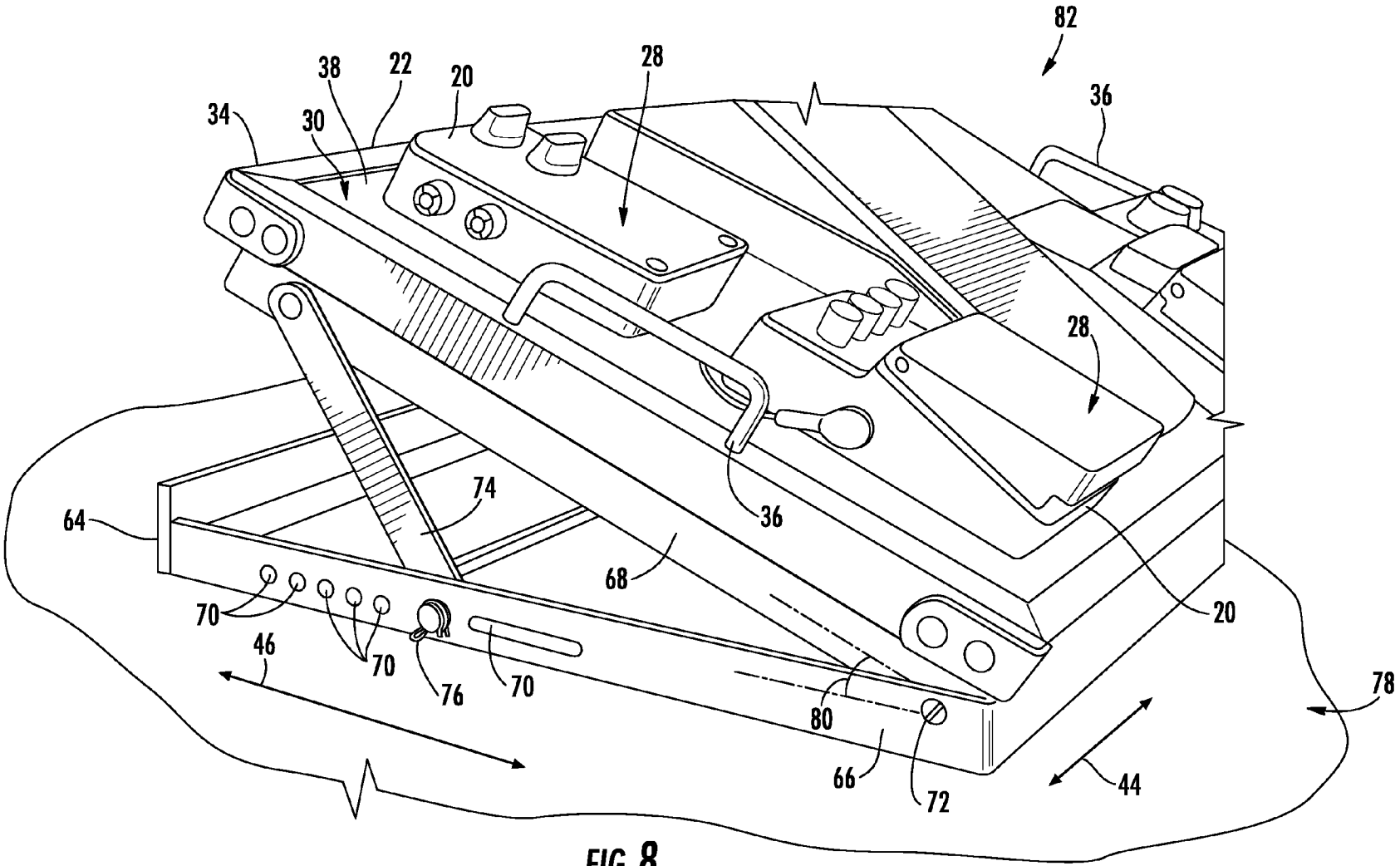
FIG. 8 is a perspective view of a pedal board with a base assembly capable of being angled in accordance with one exemplary embodiment.

FIG. 8 is a perspective drawing of a pedal board 82 that has a mounting member 22 and support frame 34, as described in FIG. 6, with a number of musical effects pedals 20 attached to the mounting member 22. The mounting member 22 and support frame 34 are attached to a base assembly 64. The base assembly 64 has the capability to adjust the angle 80 of the mounting member 22 in relation to the surface 78 upon which the base assembly 64 rests to any functional angle 80 desired by the artist. However, it is to be understood that the base assembly 64 need not be adjustable in other exemplary embodiments such that the angle 80 is not adjustable in these other embodiments.

The surface 78 onto which the pedal board 82 rests may be a stage, podium, a raised stage, or any other surface onto which the user desires the pedal board 82 to be placed. The surface 78 may be a planar surface such that a surface normal to the surface 78 extends vertically upwards away from the direction of gravity. In other arrangements, the surface 78 need not be a planar surface and/or may be angled such that a surface normal to the surface 78 has a component that extends upwards away from gravity and a component that extends along the lay of the surface 78. The surface 78 may be a vertical wall in some arrangements. The surface 78 may be a carpeted floor. It is to be understood that as used herein, the terms surface and floor are broad enough to include one another and so that they cover any type of structure onto which the pedal board 82 may be placed.

A method to support a pedal board's 82 mounting member 22 would allow the musician to adjust the angle 80 between the pedal board's 82 mounting member 22 and the surface 78 upon which the base assembly 64 rests to any functional or desired angle by attaching the mounting member 22 and its support frame 34 (if required) to a base assembly 64 by using a pivot point 72 and a system to hold the mounting member 22 at the desired angle 80.

A method may use a support arm 74 which connects to a base assembly 64 by way of a number of support openings 70 where the angle 80 of the mounting member 22 may vary based upon which support opening 70 is used or by where the support arm's 74 retaining device 76 is placed in an elongated support opening 70. Any method may be used whereby the angle 80 of two surfaces relative to each other may be changed and held in place and later changed to another angle 80 by use of an attachment method capable of holding the two surfaces in place on a permanent or temporary basis. This concept is unique in pedal board 82 applications.

The base assembly 64 may include a first portion 66 that lays flat and engages the floor 78. A second portion 68 can be pivotally attached to the first portion 66 by way of the pivot 72. The mounting member 22 may be permanently or removably attached to the second portion 68 through any manner of means. For example, adhesion, mechanical fasteners, integral formation, or sonic welding may be used to permanently or removably attach these components. Further, the support frame 34 may fit over the second portion 68 so that the second portion 68 in effect nests onto the second portion 68 to hold the support frame, and hence mounting member 22, to the second portion 68.

The support openings 70 can be apertures that are circular that extend through a side wall of the first portion 66 and extend in a row in a lateral direction 46. The support opening 70 may also comprise a slot located on one side of the circular openings that extends in the lateral direction 46. The support arm 74 may be pivotally attached to the second portion 68 on one end, and may be connected to and detached from the first portion 66 on an opposite end. The retaining device 76 can be used to attach and detach the support arm 74 from the first portion 66.

The retaining device 76 may be a threaded bolt and a wing nut. The threaded bolt may be disposed through an aperture of the support arm 74 that is aligned with one of the circular support openings 70 or is aligned with the slot of the support openings 70. The threaded bolt may be disposed through both of these aligned openings and then the wing nut can be applied to the threaded bolt in order to fix the location of the end of the support arm 74 to the first portion 66. However, it is to be understood that various mechanisms of attachment of the support arm 74 to the first portion 66 may be employed in other arrangements. For example, the retaining device 76 can be constructed so that instead of a wing nut, a retaining device 16 as disclosed previously that has a female receiving member is used in its place. This retaining device 16 may be screwed onto a threaded bolt that is also included in the retaining device 76. Any one or plurality of components can be included in the retaining device 76 in order to effect attachment of the support arm 74 to either the first portion 66 or the second portion 68.

The retaining device 76 allows for a secure and easy attachment and detachment of the support arm 74 to the first portion 66. Although disclosed as being used to attach the support arm 74 to the first portion 66, the retaining device 76 may be used to attach and detach the support arm 74 to the second portion 68 while the first portion 66 is permanently pivotally attached to the support arm 74. In yet other exemplary embodiments, a pair of retaining devices 76 may be used so that the support arm 74 may be attached to and detached from both the first portion 66 and the second portion 68.

FIG. 8 reveals only one side of the base assembly 64. The opposite side of the base assembly 64 is not visible in the figure. The opposite side may be arranged with a support arm 74 in a manner similar to that disclosed so that the second portion 68 is supported on opposite sides. In other embodiments, the opposite side is not supported with a support arm 74.

The angle 80 may be the angle from the floor 78 to the top surface 28 of the mounting member 22. Since the top surface 28 can be parallel to the bottom surface 26, the angle 80 may also be the angle from the floor 78 to the bottom surface 26. In a similar manner, the top surface 28 of the musical effects pedals 20 may be parallel to both the top surface 28 and the bottom surface 26. The angle 80 may be the angle from the floor 78 to the second portion 68. Further, in yet other exemplary embodiments, the angle 80 may be the angle from the first portion 66 to the second portion 68. The angle 80 may be the angle from the floor 78 to the top surface 28. The angle 80 may be from 0°-45° in certain arrangements and may be from 45°-90° in yet other exemplary embodiments. In certain exemplary embodiments, the angle 80 may be up to 30°. The angle 80 can be adjusted as desired in order to achieve a desired angle and positioning of the musical effects pedals 20 to the foot of the user.

Figure 9:
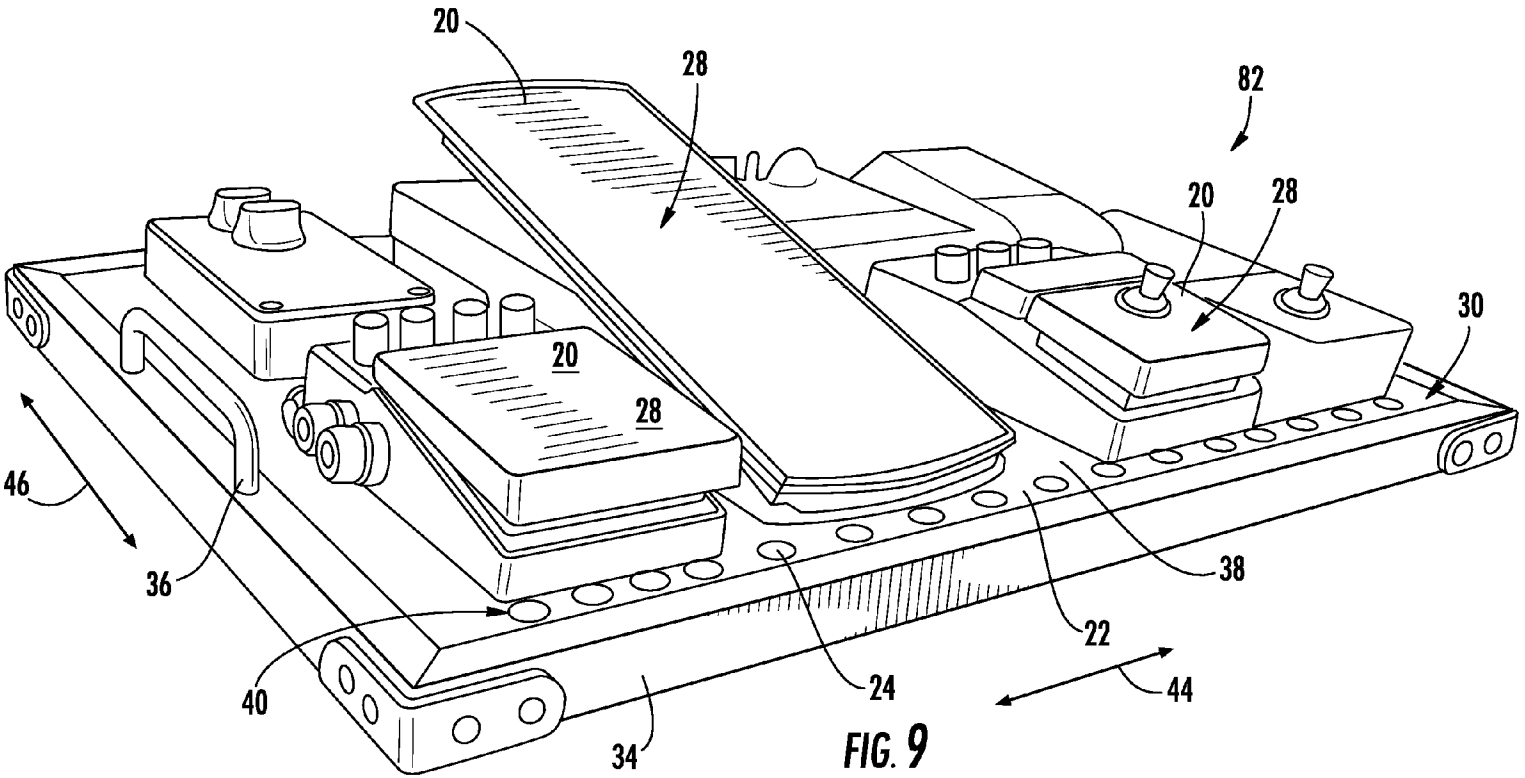
FIG. 9 is a perspective view of a mounting member with a plurality of musical effects pedals attached thereto.

FIG. 9 is a perspective drawing of numerous musical effects pedals 20 attached to a mounting member 22 without a base assembly 64 as shown in FIG. 8. This figure does not contain any concepts not previously described but is included as an additional view to further understand the musical effects pedal retaining device 10 and pedal board 82 disclosed herein.

The musical effects pedal retaining device 10 would provide a temporary attachment to a pedal board's 82 mounting member 22 which has the potential to remain permanent but may be removed at any time at the discretion of the artist. Additionally, the musical effects pedal retaining device 10 would provide an attachment which would be a firm connection to the pedal board 82 without any unwanted movement of the musical effects pedal 20 in relation to the pedal board's 82 mounting member 22. The connection may be a solid, tight and non-movable attachment. The method disclosed to support the pedal board's 82 mounting member 22 and its support frame 34 would allow the musician to adjust the angle 80 between the pedal board's 82 mounting member 22 and the surface 78 upon which the base assembly 64 rests based upon the artist's preference.

In some exemplary embodiments, the musical effects pedal retaining device 10 and associated components may be a retrofit modification. Here, an existing pedal board may have an existing mounting member. The disclosed mounting member 22 may be fit over the existing mounting member and attached or otherwise secured thereto. Alternatively, the existing mounting member may be removed and the disclosed mounting member 22 can be fit onto or into the existing support frame.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed:

1. A pedal board, comprising:

an attachment mechanism;

a mounting member, wherein the mounting member has a flat upper surface and a lower surface, wherein the mounting member defines a plurality of openings that extend from the upper surface to the lower surface;

a musical effects pedal retaining device that has a mounting plate that engages the attachment mechanism, wherein the musical effects pedal retaining device has a connecting device that is carried by the mounting plate and that has external threading, wherein the musical effects pedal retaining device has a retaining device that has internal threading and that has an exterior surface capable of being grasped and turned by a user, wherein the internal threading is capable of engaging and disengaging the external threading such that the user can turn the retaining device in order to engage and disengage the internal and external threading to releasably attach the musical effects pedal retaining device to the mounting member;

a musical effects pedal that is attached to the attachment mechanism, wherein at least a portion of the musical effects pedal retaining device is releasably attachable to the mounting member so as to function to assist making the musical effects pedal releasably attachable to the mounting member, wherein the at least a portion of the musical effects pedal retaining device is releasably attachable to the mounting member through a mechanical engagement that is not a hook and loop type fastener;

wherein when the musical effects pedal is attached to the mounting member the mounting plate engages the upper surface of the mounting member and the retaining device engages the lower surface of the mounting member, and wherein when the musical effects pedal is attached to the mounting member some of the external threading of the connecting device is located within one of the openings of the mounting member, wherein the musical effects pedal is detachable from the mounting member and is attachable to a different location of the mounting member such that a portion of the external threading is located within a different one of the openings of the mounting member; and a base assembly that has a first portion and a second portion and a pivot that functions to place the first portion into pivoting engagement with the second portion such that an angle between the first portion and the second portion is capable of being adjusted by the user, wherein the first portion rests on a floor, and wherein the mounting member is carried by the second portion, wherein adjustment of the angle between the first portion and the second portion causes an adjustment of an angle between the musical effects pedal and the floor, wherein the angle between the first portion and the second portion is the same degree as the angle between the musical effects pedal and the floor.

2. The pedal board as set forth in claim 1, wherein when the internal threading and the external threading are engaged such that the musical effects pedal retaining device is attached to the mounting member the attachment mechanism does not engage the upper surface of the mounting member.

3. The pedal board as set forth in claim 1, wherein the mounting member defines a plurality of openings that extend from the upper surface to the lower surface, wherein some of the openings are lateral apertures that are slots that extend in a lateral direction of the mounting member, wherein some of the openings are longitudinal apertures that are slots that extend in a longitudinal direction of the mounting member, wherein some of the openings are angled apertures that are slots that extend in both the longitudinal and lateral directions of the mounting member.

4. The pedal board as set forth in claim 1, wherein the base assembly further defines a support arm that is pivotally attached to the second portion, wherein the first portion has a plurality of support openings, wherein the support arm is capable of being attached to the first portion at one of the support openings to fix the angle between the first portion and the second portion at a certain degree, and wherein the support arm is capable of being detached from the first portion and then reattached to the first portion at a different one of the support openings to fix the angle between the first portion and the second portion at a different degree.

5. The pedal board as set forth in claim 4, wherein the base assembly wherein the first portion has a support opening that is a slot that extends in a lateral direction, wherein the support arm is capable of being attached to the slot at a first location to fix the angle between the first portion and the second portion at a certain degree.

6. The pedal board as set forth in claim 1, wherein the mounting member plurality of openings that extend from the upper surface to the lower surface, wherein the openings are circular in shape, and are arranged in a series of columns that extend in a lateral direction of the mounting member and are arranged in a series of rows that extend in a longitudinal direction of the mounting member.

7. The pedal board as set forth in claim 1, wherein the base assembly further defines a base assembly retaining device that has a threaded bolt that engages the support arm and a wing nut that has internal threading that engages complimentary external threading of the threaded bolt, wherein the threaded bolt is disposed through one of the openings and the wing nut engages the threaded bolt and the first portion to lock the support arm to the first portion, wherein the wing nut is capable of being disengaged from the threaded bolt to allow the threaded bolt to be removed from the opening to allow adjustment of the angle between the first portion and the, second portion.

* * * * *